United States Patent [19]

Cartwright

[11] 4,074,298

[45] Feb. 14, 1978

[54] PHOTOGRAPHIC PROCESSING MACHINE

[76] Inventor: Neil B. Cartwright, 693 E. 16th St., Idaho Falls, Idaho 83401

[21] Appl. No.: 591,351

[22] Filed: June 30, 1975

Related U.S. Application Data

[63] Continuation of Ser. No. 436,459, Jan. 25, 1974, abandoned.

[51] Int. Cl.[2] ..... G03D 13/00

[52] U.S. Cl. ..... 354/299; 354/323; 354/331; 354/343

[58] Field of Search ..... 354/297, 299, 307, 310, 354/312, 313, 323, 327, 328, 329, 331, 332, 337, 340, 341, 343

[56] References Cited

U.S. PATENT DOCUMENTS

| | | | |
|---|---|---|---|
| 2,232,998 | 2/1941 | Cernohouz et al. | 354/331 X |
| 3,359,880 | 12/1967 | Huss | 354/299 X |
| 3,381,599 | 5/1968 | Banks | 354/323 |
| 3,626,834 | 12/1971 | Speranza | 354/329 X |
| 3,682,080 | 8/1972 | Merz | 354/327 X |
| 3,698,307 | 10/1972 | Reichardt | 354/312 X |
| 3,703,860 | 11/1972 | Wilkinson | 354/299 |
| 3,705,544 | 12/1972 | Ratowsky | 354/329 X |
| 3,727,535 | 4/1973 | Streeter | 354/325 X |
| 3,840,214 | 10/1974 | Merz | 354/330 X |
| 3,856,395 | 12/1974 | Comstock | 354/331 X |
| 3,879,119 | 4/1975 | Ratowsky | 354/343 X |

*Primary Examiner*—Fred L. Braun

[57] ABSTRACT

A photographic processing machine having a rotary drum into which the film being processed is placed, a fluid inlet and outlet so that the film may be treated with a plurality of processing fluids and a tilting mechanism for tilting the drum to drain the used processing fluid therefrom. The fluid outlet for the drum consists of a movable lid for one end of the drum which cooperates with compressible resilient seals to form a fluid tight enclosure at the one end. The fluid is drained by tilting the drum and then moving the lid from its sealing position. The processing drum has an electrical resistance wire wound about its exterior for maintaining the temperature of the fluid in the drum constant.

2 Claims, 5 Drawing Figures

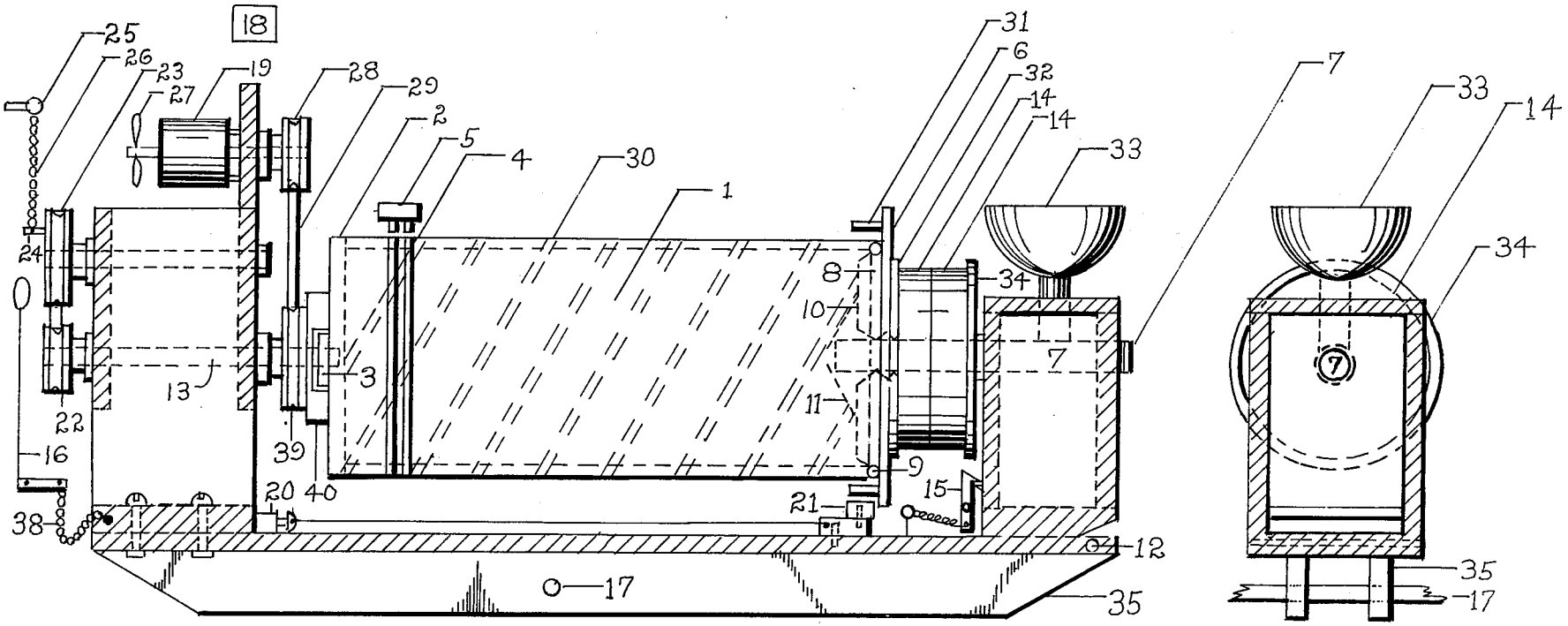
FIG. I
FIG. II
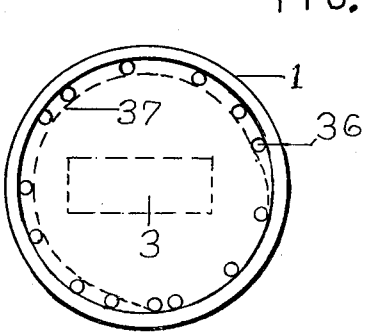
FIG. V
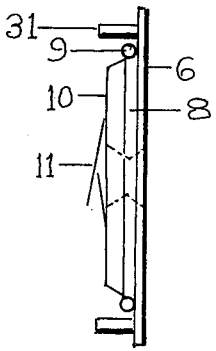
FIG. IV
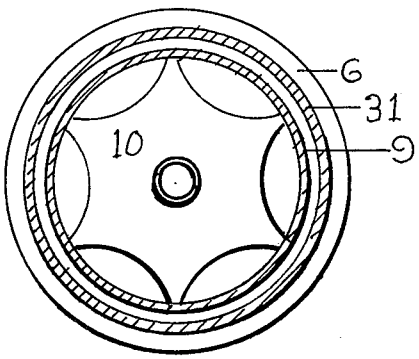
FIG. III

PHOTOGRAPHIC PROCESSING MACHINE

This application is a continuation of Ser. No. 436,459, filed Jan. 25, 1974, and now abandoned.

SUMMARY

The processing of photographic materials by wet chemistry methods has become more complex with the advent of colored processing. The temperature, the amount of aggitation, the timing, and other factors have become more critical. While there are many photographic processing machines available on the market, the machine outlined in this disclosure is unique in many ways, including the method for discharge of chemicals, the method of maintaining the temperature of the solution, the method of obtaining uniform agitation, the design of the processing tube, and the adaptability to complete automation.

DESCRIPTION OF DRAWING

FIG. I is a side view of the entire machine except for the framework and a basket used to catch the discharged solutions. These were omitted for clarity of the drawing.

FIG. II is a left end view of the chemical injection assembly.

FIG. III is a left end view of the special lid and

FIG. IV is a detailed side view of the same lid.

FIG. V is an end view of the open tube as viewed from the right.

FIG. V is important in showing how the ends of photographic sheets are secured under the edges of the round rods. The rods are spaced at infrequent intervals to allow for the accomodation of various sheet sizes, and also to act as spacers to allow solutions to flow on the back of the photographic sheet. Dimensions have been omitted (except where pertinent) as the design of the machine is not restricted to any one size. Small units can be manufactured for amature use and large units for commercial use.

DETAILED DESCRIPTION OF MACHINE

The machine as demonstrated in the drawing is housed in a metal frame compartment with a fiber glass basket to catch the rejected chemical solutions and direct them to a drain at one end of the basket. Nearly all of the materials used in construction are acrylic sheet fastened with nylon bolts to avoid corrosion. Metal parts and other types of plastic material are noted in the drawing. However, it should be noted that the invention is not confined to these specific materials. They are specified here because the materials were found to be very satisfactory during several months of rigorous testing with the prototype model.

Photographic materials are exposed and placed in the applicable light proof tube using the specified safe light for the material. The light proof lid is attached and the remaining steps are performed under normal lighting conditions. While the tube and contents are aggitated by a motor drive, preheated chemical solutions are added and rejected at specific intervals. The chemical solutions are maintained at the proper temperature by a trickle charge through a nichrome heating element that spirals the outside of the tube.

For prints and sheet film, a tube is used with small acrylic rods cemented lengthwise to the inside of the tube 1 and spaced in such a way as to accommodate all of the common sizes of sheet film and paper. The material is held in place (emulsion side inward) by tucking the edges of the material under the edges of the properly spaced acrylic rods. Additional rods are also used to hold the material away from the tube so as to allow the solution to move freely in back of the material and to drain completely during the discharge step. For roll film, smaller diameter tubes are used (without the rods) to accommodate stainless steel reels. Several reels can be processed at one time. When reels are used, a water tight plunger is positioned inside the tube to regulate the number of reels processed and thus minimize the amount of solution required. For movie film, special reels can be used or a large spiral cartrage, that fits inside the tube is used.

The left end of the tube 2 is an opaque plastic material with a rectangular cleat 3 across the middle and a center hole to engage the shaft on the tube drive assembly. When properly placed, the cleat engages in a slot on the drive assembly. The tube is wound with a spiral nichrome heating wire attached to two small brass commutator bands 4 attached to the peripheral of the tube. An external swinging arm, with two brushes 5 is placed in contact with the commutator bands during operation. On top of the nichrome wire, the tube is wrapped with a layer of insulating material followed by a layer of opaque tape. The tape holds the insulation in place and makes the tube lightproof. A small amount of regulated current (calibrated for the various processes) controlled by a rheostat is used to maintain the tube temperature the the same as the processing solution. The current is supplied by a low voltage (high power) transformer to avoid personal hazard from shock. The tube heating unit was not designed to heat the chemical solutions but only to maintain the temperature of the preheated chemicals after they have entered the tube. The lid 6 is made of opaque plastic with a large hole through the center to accommodate the tubular shaft 7. Going inward, another plastic disk 8 (slightly smaller than the inside diameter of the tube) is cemented to the large disk. Around the peripheral of this disk 8 is cemented a soft rubber tube 9. The rubber tube is also cemented to the large disk 6. This rubber tube makes contact with end of the large processing tube to form a water tight seal when pressure is applied. Another plastic disk 10 is cemented to the disk 8. This disk also has a diameter slightly less than the inside diameter of the tube and holds the lid in place during the draining step. To provide good draining, the disk 10 is not a solid circle but is fabricated as shown in the end view of the lid. Attached to the disk 10 are thin opaque rubber flaps 11 that cover the hole in the center to exclude light during the period that the tube is being loaded in the machine. When engaged, the end of the tubular shaft forces the rubber flaps open to allow free addition of the chemical solutions. When placing the tube on the machine, the entire chemical injection assembly is pivoted backwards at pivot 12 to allow clearance for the tube and ease of loading the tube. The right end of the tube is then engaged in the tubular shaft. The left end of the tube is then lowered into place and engaged with the drive shaft 13. This is done be exerting a slight force on the tube (toward the right) and compressing the spongy urethane foam disks 14. The chemical injection assembly is now held in place with a spring loaded latch 15 when returned to the operating position. When the tube is in place, the urethane foam disks are partially compressed exerting pressure on the lid and maintaining a water tight seal on the tube. The soft urethane disks are used here for a dual purpose. First, the partially compressed disks hold the lid firmly in place during rotation, and second, the spongy disks allow for a displacement of the bottom edge of the lid during the discharge of used chemicals. The hole in the middle of the lid is beveled on both sides but fits the axel at the center. This allows for a lateral displacement of the lid during the chemical rejection step. During operation, all of the disks on the chemical injection assembly rotate with the drum. Pre-heated chemical solutions are added through the funnel as required. When the chemicals are ready to be rejected, the mechanical lever 16 is shifted and the entire assembly is tilted downward to the right on the pivot 17. At the same time, the micro switch (DPDT) 18 is engaged and this in turn stops the drive motor 19 and energizes the solenoid 20. The solenoid pulls a lever with an idle wheel attached 21 (normally in close proximity to the edge of the large lid disk but not touching). The lid is displaced laterally toward the right and the solutions are allowed to drain. Only a slight tilt 10°-20° is required for good drainage. The disk 10 holds the lid in place during the chemical discharge step. About 5 seconds are required for good drainage. The lever 16 is then returned to its normal position, the lid is secured, and the motor drive is again energized. Pre-heated chemical solutions are then added through the funnel. In addition to the aggitation produced by rotation, the entire assembly moves up and down (rocking on pivot shaft 17) at a rate that produces optimum conditions of aggitation inside the tube. The ratio of the time required for one complete cycle (up and down) to the time of one revolution of the tube is an important factor and was determined by many experiments with different ratios. The ratio established for optimum aggitation was 1½ revolutions of the tube per one complete cycle of up and down motion. Numerous experiments with uniformly exposed film indicated that this ratio produced the most uniformly developed film without streaking. This ratio is accompolished by the pulley wheels 22 and 23. The rocking motion is accompolished by the off-set pin 24 extruding from the pulley wheel 23 and a chain attaching the pin to a fixed fastener on the stationary framework of the machine. The rocking pivot shaft 17 is also attached to the framework. The chain is used to allow for slack when the assembly is tilted for discharging chemicals.

A fastener 25 such as a screw eye is secured to the stationary frame. A chain 26 attached from this fastener to the off-set pin 24 on the pulley wheel 23 provides the rocking action of the entire assembly shown in FIG. I. The gear motor 19 that provides both the rocking motion and the rotation of the tube is cooled by the fan 27 which is an integral part of the gear motor. The pulley wheel 28 is attached to the motor shaft 7 and provides rotation of the shaft 13 by connecting pulley wheels 28 and 39 with the V-belt 29. An electrical resistance heating wire (or heating tape) 30 is wound around the outer circumference of the tube 1 in a spiral fashion to maintain the temperature of the tube at the same temperature of the injected processing solutions, that enter the tube through the funnel 33 and the hollow axel 7. The plastic disks 32 and 34 slide freely over the tubular hollow axel 7 and are used as front and back supports for the soft spongy disks 14. Disk 32 has a beveled hole in the center so that lateral displacement of the lower edge of the disk can be accomplished in conjunction with the lateral displacement of the lid (FIG. IV) during discharge of chemicals. An opaque light shield rim 31 allows for lateral displacement of the lid without allowing light to enter the processing tube. The entire assembly in FIG. I is supported by heavy plastic support beams 35 so that rocking motion can be effected at the rocking shaft 17. Round rods 36 are cemented lengthwise along the inner surface of the processing tube to provide a method of securing the ends of the photographic sheet material 37. The rods are spaced at specific locations to allow for the use of all normal sizes of photographic material. The round rods provide a dual purpose by also acting as spacers between the inner surface of the processing tube and the back of the photographic sheet thus allowing the processing solutions to flow freely in this space. A chain 38 connects the lever 16 with the entire assembly (FIG. I) so that the tube can be tilted for discharging the chemicals. The chain has sufficient slack so that it does not restrict the rocking motion of the assembly. Attached to the pulley 39 is a small disk with a wide groove through the center 40 which allows the cleat 3 to engage in the groove and provide the rotational motion of the tube by the shaft 13.

I claim:

1. Apparatus for processing photographic sheet material, said apparatus comprising:

a tubular processing vessel having at least one open end, means for rotatably supporting and rocking the tubular vessel, means for mounting the sheet material in the interior of said vessel and for spacing the back of the sheet material from the inner surface of said vessel, means for supplying processing solution to the interior of said vessel, and means for discharging the used processing solution from the vessel, wherein said discharging means includes a movable lid for closing the open end of the vessel in a fluid tight manner, resilient means for exerting pressure on the lid to maintain it in the closed position, means for tilting the vessel for draining the solution, and means for removing the pressure exerted by the resilient means on the lid to thereby allow the solution to be drained from the vessel.

2. Apparatus for processing photographic sheet material, said apparatus comprising:

a tubular processing vessel, means for rotatably supporting and rocking the tubular vessel, means for mounting the sheet material in the interior of said vessel and for spacing the back of the sheet material from the inner surface of said vessel, means for supplying processing solution to the interior of said vessel, and means for maintaining the temperature of the processing solution in the vessel constant, wherein said temperature maintaining means includes an electrical resistance wire wound spirally around the tubular vessel, said wire being electrically insulated from the vessel, commutator means electrically connected to said wire, means for supplying electrical power to the commutator means, and means for regulating the electrical power supplied to the commutator means.

* * * * *